US005199293A

United States Patent [19]

Catti et al.

[11] Patent Number: 5,199,293

[45] Date of Patent: Apr. 6, 1993

[54] SHEET WORKPIECE BENDING MACHINE

[75] Inventors: Alberto A. Catti; Franco Sartorio; Stefano Vergano, all of Turin, Italy

[73] Assignee: Amada Company, Limited, Japan

[21] Appl. No.: 795,045

[22] Filed: Nov. 20, 1991

Related U.S. Application Data

[63] Continuation of Ser. No. 459,292, Dec. 29, 1989, Pat. No. 5,092,151.

[30] Foreign Application Priority Data

Dec. 29, 1988 [IT] Italy ..... 68165 A/88
Dec. 29, 1988 [IT] Italy ..... 68166 A/88

[51] Int. Cl.[5] ..... B21J 7/32

[52] U.S. Cl. ..... 72/443; 72/7; 72/389; 72/441; 72/452

[58] Field of Search ..... 72/7, 22, 342, 389, 72/407, 441, 443, 452, 453.03, 453.11

[56] References Cited

U.S. PATENT DOCUMENTS

| | | | |
|---|---|---|---|
| 3,143,007 | 8/1964 | Thompson | 72/453.03 |
| 3,707,866 | 1/1973 | Brauer | 72/453.11 |
| 3,841,140 | 10/1974 | Hryc | 72/441 |
| 4,559,807 | 12/1985 | Gango et al. | 72/454 |
| 4,646,555 | 3/1987 | Postupack | 72/453.03 |
| 4,838,069 | 6/1989 | Walker et al. | 72/342.1 |
| 4,924,693 | 5/1990 | College et al. | 72/453.03 |

FOREIGN PATENT DOCUMENTS

| | | |
|---|---|---|
| 717153 | 10/1952 | United Kingdom . |
| 1393283 | 7/1972 | United Kingdom . |
| 1411706 | 6/1973 | United Kingdom . |
| 1399327 | 7/1975 | United Kingdom . |
| 2018175 | 3/1979 | United Kingdom . |

OTHER PUBLICATIONS

Dreis & Krump Manufacturing Co., "Select-a-Speed", Oct. 29, 1964, Iron Age, p. 104.

*Primary Examiner*—David Jones
*Attorney, Agent, or Firm*—Wigman & Cohen

[57] ABSTRACT

The press is of the type including a pair of tool holders mounted in a frame and carrying cooperating tools (die and punch). At least one of the tool holders is motor driven and is movable towards the other tool holder. According to the invention, the press includes a first driver arranged to make one of the tool holders travel a fairly long distance towards the other tool and a second driver, distinct from the first, for making this same tool holder or the other tool holder perform, a subsequent, fairly short working stroke to bend the sheet metal and to effect any coining of the bend. Preferably both of the tool holders are movable, the second driver being arranged to make the respective tool holder complete a fairly short bending stroke, and the press includes a third driver, distinct from the first and second, arranged to make the same tool holder and the other tool holder complete a vertical stroke for coining the bend.

6 Claims, 7 Drawing Sheets

SHEET WORKPIECE BENDING MACHINE

This is a continuation of co-pending application Ser. No. 07/459,292 filed on Dec. 29, 1989, now U.S. Pat. No. 5,092,151.

BACKGROUND OF THE INVENTION

1. Field of the Invention

The present invention relates to a sheet workpiece bending machine such as a sheet-metal bending press.

2. Description of the Prior Art

The cold bending of metal sheets is currently carried out by bending presses, an example of which is illustrated schematically in perspective in FIG. 1.

These presses include a frame 10 constituted by one or more strong, C-shaped structures. The frame 10 carries two strong, parallel steel beams 12 and 14, usually arranged in a vertical plane. One of the beams, for example the upper one 14, is movable so that it can be moved towards and away from the other beam 12 while remaining constantly parallel thereto. The double arrow Z indicates the direction of movement of the upper beam 14 or, at any rate, of the relative movement of the two beams. This direction will be referred to below conventionally as the "working direction".

The two beams 12 and 14 constitute respective tool holders for a pair of cooperating tools in the form of a die 16 and a punch 18 which are usually V-shaped. The sheet metal interposed between the die 16 and the punch 18 is bent into the shape of these tools when they are pressed against each other.

In conventional presses, the movement of the movable beam 14 and the force with which it is pressed against the other beam 12, which is usually fixed, are achieved by a mechanism which applies the force at a single point, if the machine is small (for bending lengths usually less than 1 m), or at two points situated symmetrically at the ends of the movable beam 14 in the case of medium and large-sized bending presses. This mechanism may be of various types and its force is usually developed by hydraulic cylinders or hydraulic motors.

In the case of high-precision bending presses, where the distance between the die and the punch must be adjusted accurately to produce a bending angle within strict tolerances (for example with an angular error of a few minutes of a degree) it is necessary to use numerically-controlled drive motors. This well-known technique requires the continuous and automatic measurement of the distance between the die 16 and the punch 18. In this case hydraulic drives (cylinders or motors), which are usually preferred for the high power which they can develop with components of a very limited size, are not very suitable. In fact, not only are the hydraulic slave mechanisms not very precise, but their performance also varies considerably during the course of a working day as the hydraulic fluid gradually heats up. Moreover, the large quantity of heat developed is transmitted to the frame of the machine and can cause deformation which reduces the precision of the system even more.

For the reasons set out above, the current tendency is to prefer electric servo-motors which are very precise and which perform consistently. Moreover, because of their very high efficiency, such servo-motors generate much smaller quantities of heat than those generated by hydraulic cylinders and motor.

The disadvantage of electric servo-motors lies in the fact that they are much more bulky and expensive than hydraulic drives, for a given power developed, and require kinematic mechanisms, such as the beam 14 of FIG. 1, which are also more expensive, for transmitting the drive to the movable tool holder.

SUMMARY OF THE INVENTION

The object of the invention is to produce a high-precision bending press which requires very low-power servo-motors for a given bending force and a given bending time.

According to the invention, this object is achieved by means of a sheet workpiece bending machine comprising a frame; upper and lower bending tools supported on the frame, free to relatively move toward and away from each other for bending a sheet workpiece interposed therebetween; a first drive means for relatively moving at high speed the upper bending tool and/or the lower bending tool towards and away from each other, when the spacing between the upper and the lower bending tools is relatively large; and a second drive means for relatively moving with procision the upper bending tool and/or the lower bending tool toward and away from each other, when the spacing between the upper and lower bending tools is relatively small.

BRIEF DESCRIPTION OF THE DRAWING

The invention will become clearer from a reading of the detailed description which follows with reference to the appended drawings, which illustrate a currently-preferred embodiment of a bending press according to the invention, and in which.

DESCRIPTION OF THE PREFERRED EMBODIMENTS

First, the theory on which the invention is based will be explained with the aid of FIG. 2 which shows schematically three phases A, B and C in the bending of a metal sheet.

Figure 2:
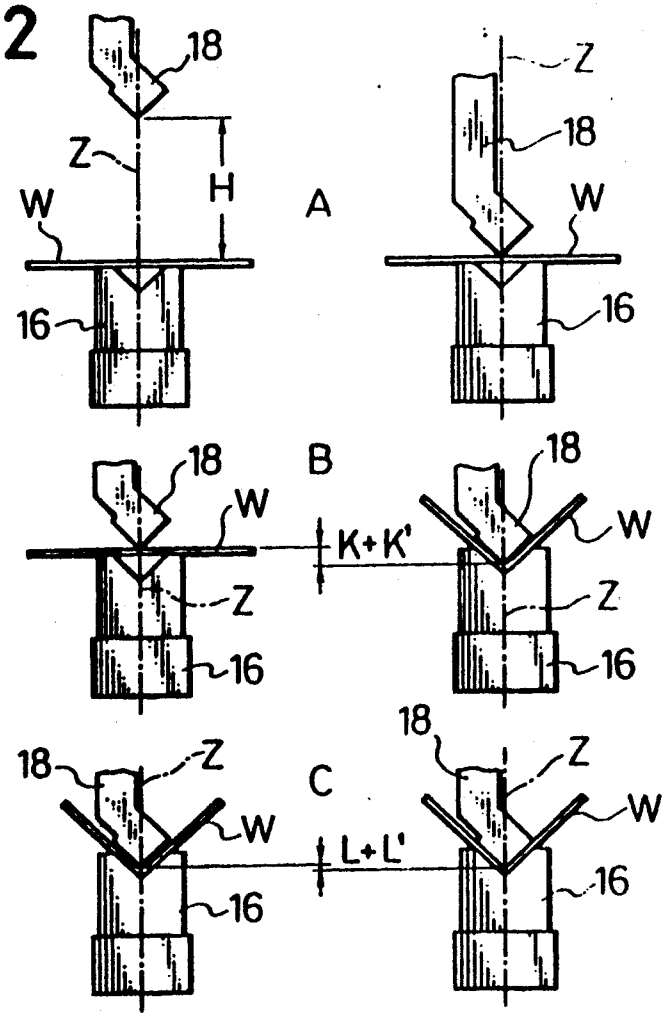
FIG. 2 is a schematic diagram showing three bending phases carried out in a preferred embodiment of a bending press according to the present invention.

In FIG. 2 the die (lower bending tool) is again indicated 16, the punch (upper bending tool) is again indicated 18, and the working direction is again indicated Z. The invention is based on the observation that the movement necessary for effecting the bending can be divided into two, or in certain cases, three phases.

FIG. 2 shows an "approach" phase at A. This phase starts with a situation in which the press is completely or partially open (the punch 18 is at a height H from the metal sheet W which rests on the die 16). This situation is necessary to allow the preceding workpiece to be removed. Phase A ends when the vertex of the punch 18 touches the piece W.

Phase B is the bending stage proper, in which the punch and the die copenetrate and bend the interposed metal sheet W. In this phase the punch 18 travels a distance K, much shorter than the distance H, relative to the die 16.

Phase C is used only in the case of high-precision bending and is known as "coining".

If the bending operation is terminated after the bending phase B, when the metal sheet is released, it re-opens resiliently to a certain extent; that is to say, the final bending angle is not exactly that imposed by the machine. If, however, the coining phase C is carried out, with forces five or more times greater than those required in the bending phase B, the metal is brought to a condition of complete plasticity (the so-called total-yield state) so that the final angle of the sheet metal is that imposed by the machine. During the coining phase, the relative displacement L of the punch 18 and the die 16 is almost nil and is described herein, in the conventional manner, as a "virtual displacement".

It can easily be seen that the three phases A, B, and C are distinguished by values of force and displacement, as well as by essentially different manners of displacement, as follows.

Phase A

The displacement H (from 100 to 200 mm approximately) is the greatest and is normally approximately ten times greater than the displacement K of phase B.

The force is very small, equal to the weight of the movable beam 14 and its punch 18, which in some cases could be entirely counterbalanced. The force does not deform the structure, or frame 10;

the displacement H must occur as quickly as possible and may be caused by an all-or-nothing control.

Phase B

The force is very high. It increases very rapidly since the material in the bending zone changes from a resilient state to one of local yielding. The force then remains substantially constant whilst the bending angle increases. This relates to the so-called "in air" bending phase. The force then increases again suddenly, at the point at which the sheet metal on the two sides of the vertex of the bend becomes parallel to the sides of the die 16 and the punch 18. This condition is known as "full" bending.

The total displacement in phase B is made up of two components K and K': in fact in this phase, in which the die 16 and the punch 18 are in contact through the metal sheet W, the structure, or frame, 10 of the machine deforms to a certain extent as a result of the bending force. The kinematic mechanism which drives the movement must therefore execute an overall displacement of K (the relative movement of the die 16 and the punch 18), which varies from about 5 to 20 mm, plus K' (the deformation of the structure of the machine), where K' is usually much smaller than K. In any case K+K' is much smaller than H;

The relative displacement of the die 16 and the punch 18 in this phase must be gradual and metered accurately by the numerical control through a measurement of the displacement, excluding the component due to the deformation of the structure. The execution of stage B under numerical control enables precise bending "in the air" to be obtained through various angles once the value of the resilient return of the bend being effected is known from tests on samples. In any case, the sheet metal can be followed accurately by the manipulating robot which supports it.

Phase C

The force is extremely high, equal to at least five times that used in phase B. The magnitude of the force must be metered carefully in dependence on the size and thickness of the piece W and the type of material so as not to deform the bending zone unacceptably.

The displacement executed by the drive mechanism is constituted by two components, which L (the relative movement of the die 16 and the punch 18) is very small (from several tenths of a mm to slightly more than one mm) whilst the deformation of the structure, indicated L', may be somewhat greater than L. As a result, L+L' is comparable in size to K+K' in phase B.

The application of the coining force may be effected by a non-gradual control (all or nothing). The displacement results therefrom and does not have to be checked.

On the basis of the above observations, the invention consists in the assignment of the two phases A and B or of the three phases A, B and C of the bending to distinct drive members or motor means.

First of all, a bending press of a more common type, for which coining is not envisaged, will be considered. In this case, the approach phase A will be entrusted to first drive means of the low cost, high speed, "all or nothing" type, such as for example, one or more pneumatic cylinders. The displacement of phase B, however, will be assigned to one or more electric servo-motors with respective kinematic mechanism.

In conventional presses the maximum speed of the servo-motor corresponds to the speed of approach of the punch and die in phase A. In order not to render the time for the bending operation unacceptably long, this maximum speed must be higher than (for example 10 times) that of phase B.

Since, as is known, servo-motors have a constant torque, when the motor goes on to effect phase B in accordance with the prior art, the speed of phase B being ten times less, it may produce a power which, in the example, will be ten times less than its nominal power.

It should be noted that a single motor which effects the two phases A and B must execute phase B with precise control of the position and speed whilst, in phase A, the devices by which the precision is achieved are completely wasted.

According to the invention, however, the maximum speed of the phase B servo-motor must correspond to the maximum speed of phase B alone, which is ten times less, for example. It is thus clear that a servo-motor for phase B alone will have a nominal power which is ten times less than that of a motor used for both phases A and B.

A conventional bending press which also executes the coining phase C will now be considered. As stated, this phase involves a total displacement L+L' of the kinematic mechanism which is of the same order of magnitude as the displacement K+K' of phase B, but the force exerted is at least five times as great as that of phase B. In this case, the power required by the single servo-motor of the prior art is clearly of the order of five times as much as that needed to carry out phase B, if a quite long execution time for phase C, such as that of phase B (that is several seconds), is accepted whilst it would be desirable for the coining to be almost instantaneous. It should also be noted that, in phase C, what is necessary is to meter not the displacement, which is a factor resulting from the plasticity of the sheet metal and the resilience of the machine, but the force developed.

In a simple embodiment of the invention it is possible to use first drive means for only the approach travel of phase A and second drive means for both the bending and the coining phases B and C. preferably, however, a solution is adopted in which third drive means, distinct from the first and second drive means, are used to carry out the coining of phase C.

Figure 1:
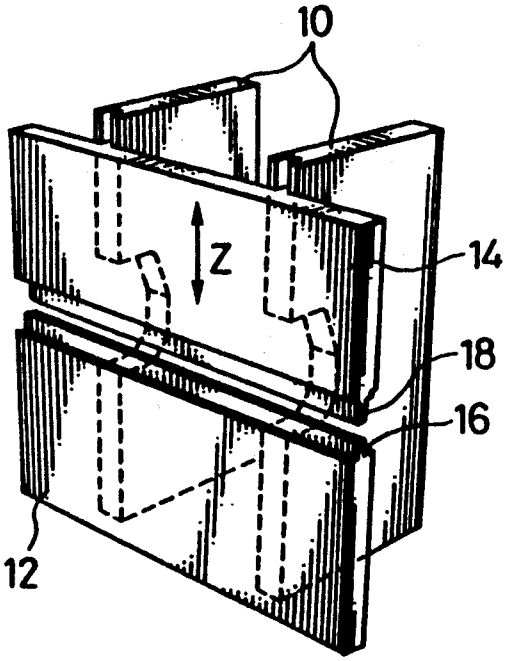
FIG. 1 is a schematic diagram showing a construction of a conventional bending press.
Figure 3:
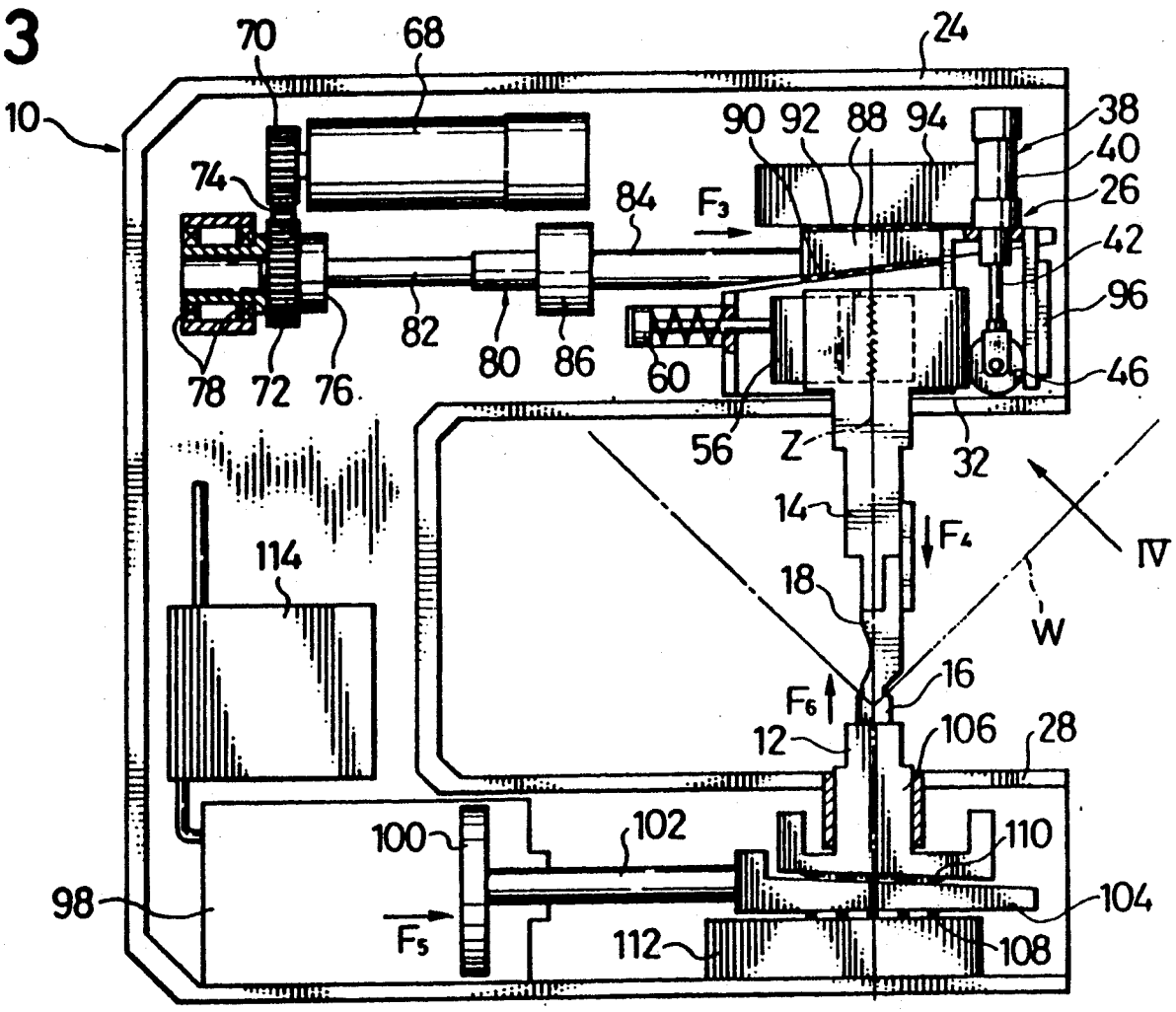
FIG. 3 is a schematic, sectioned, side elevation of the bending press according to the preferred embodiment.
Figure 4:
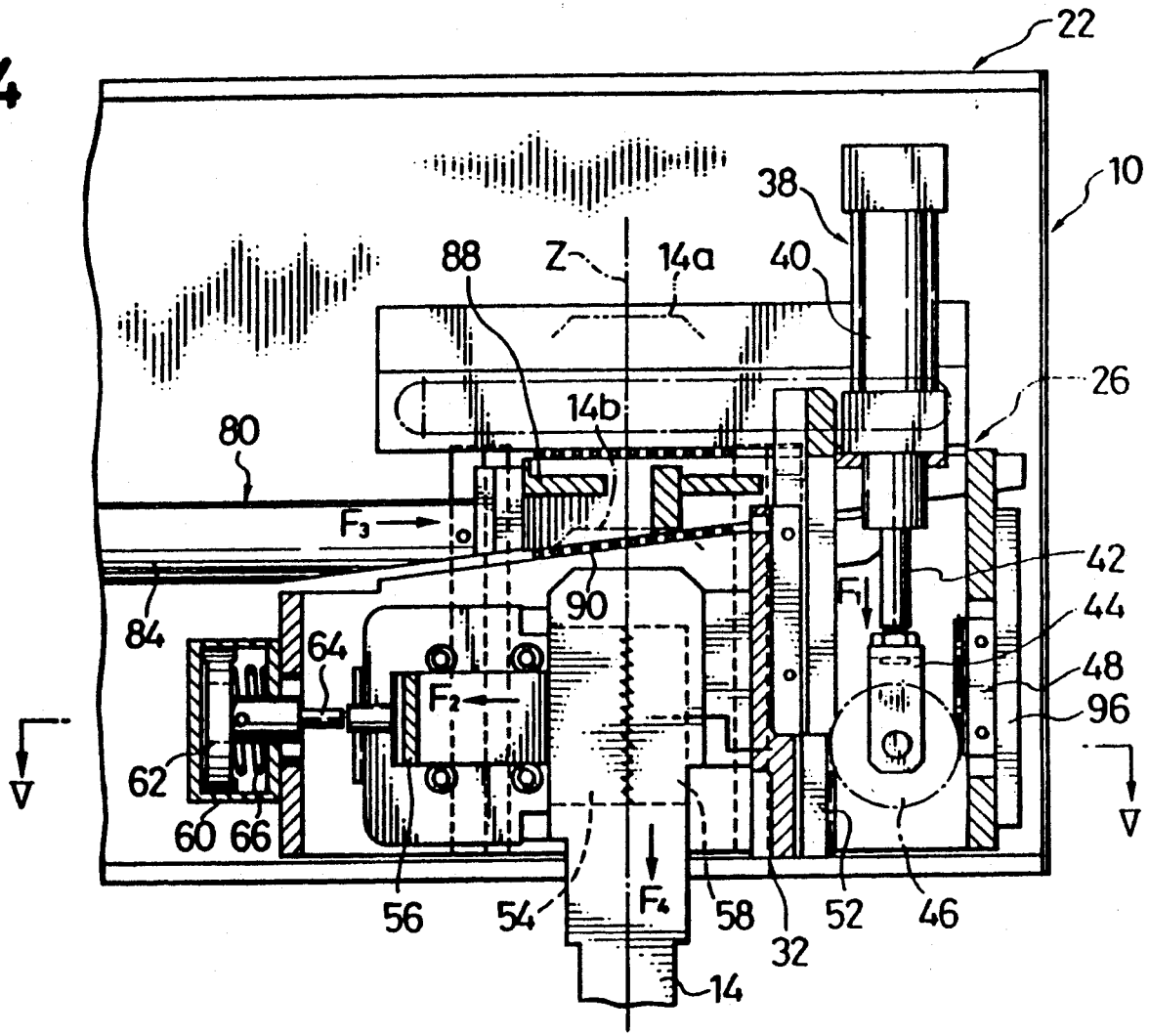
FIG. 4 is a schematic vertical section of a detail which shows the part indicated by the arrow IV of FIG. 3 on an enlarged scale.
Figure 5:
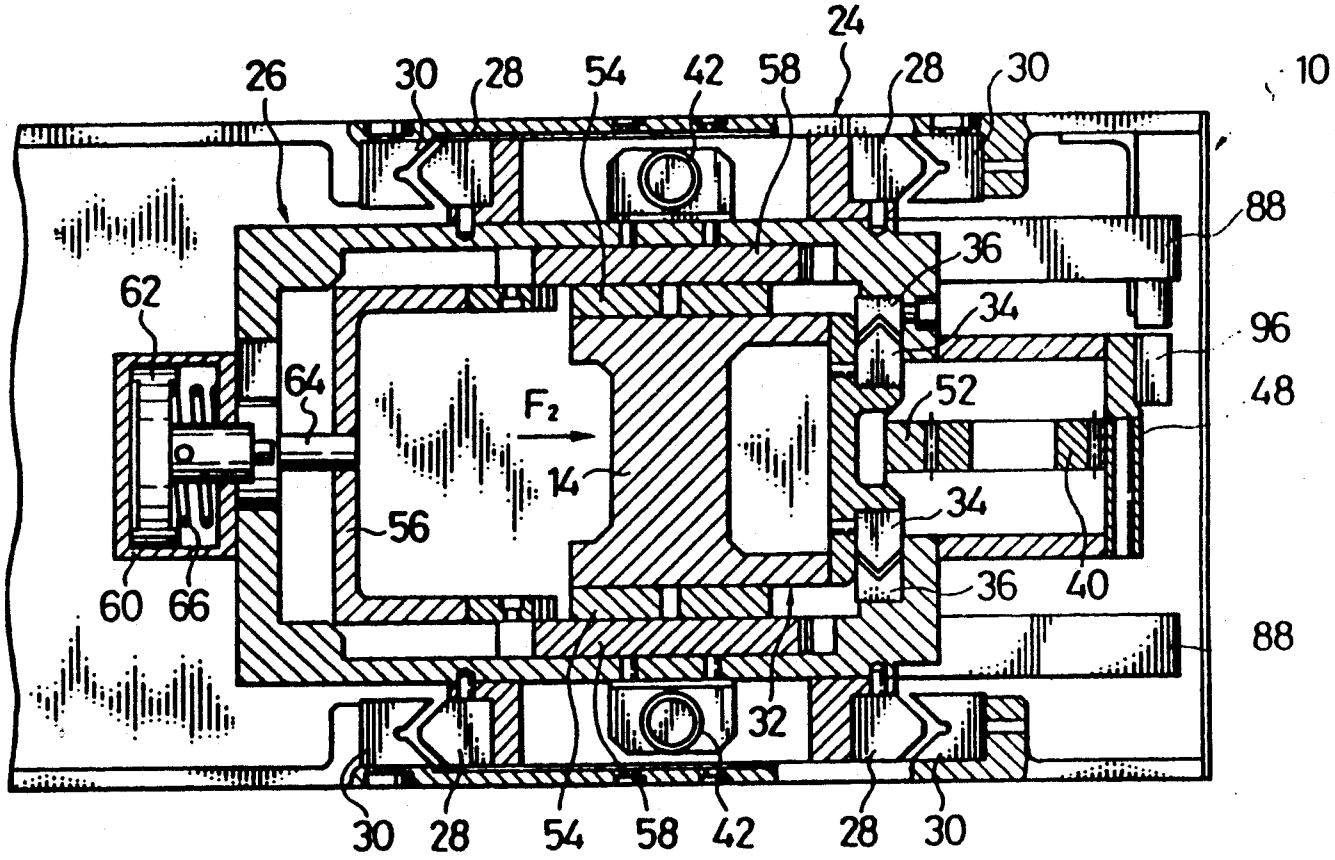
FIG. 5 is a schematic horizontal section taken in the horizontal plane V-V of FIG. 4.

In FIGS. 3 to 5, a frame corresponding to one of the structures 10 of FIG. 1 is again indicated 10. According to its dimensions, a press may include one or more of these structures. In the case of FIGS. 3 to 5, a press with only one of these structures 10 is shown. In the case of two or more structures 10, each structure will be arranged in the manner illustrated in FIGS. 3 to 5 and the various drive means which will be described will be operated in unison.

In FIGS. 3 to 5 the lower tool-holding beam is again indicated 12 and the upper tool-holding beam 14. The die (lower bending tool) is again indicated 16 and the punch (upper bending tool) is again indicated 18. The line W in FIG. 3 again indicates the bent metal sheet.

The working direction is again indicated Z.

The lower and upper arms of the C-shaped structure are indicated 22 and 24 respectively.

In the upper arm 24 there is a first slide generally indicated 26. The slide is mounted for movement in the working direction Z by means of complementary prismatic guides 28, 30 carried by the slide itself and by the upper arm 24 respectively.

The first slide 26 is box-shaped and contains a second slide generally indicated 32. The second slide 32 is mounted for movement in the working direction Z by means of complementary prismatic guides 34 and 36 carried by the slide 32 itself and by the first slide 26 respectively.

The tool-holding beam 14 is fixed rigidly to the second slide 32.

First drive means which comprise a double-acting pneumatic or hydraulic linear actuator 38 are interposed kinematically between the first slide 26 and the second slide 32. The body 40 of the actuator 38 is fixed to the first slide 26. Its piston rod 42 extends vertically, that is, parallel to the working direction Z.

The lower end of the rod 42 carries a fork 44 in which a sprocket 46 is freely rotatable. The two slides 26 and 32 carry respective facing sets of teeth 48, 52 with which the sprocket 46 meshes simultaneously.

Two toothed bars 54 which have saw teeth extending along the working direction Z are fixed to the second slide 32. A device 56 is mounted for sliding in the first slide 26 and carries corresponding toothed bars 58 with saw teeth which are adapted to mesh with the teeth of the bars 54. The device 56 is reciprocable horizontally by means of a single-acting, hydraulic or pneumatic actuator 60, to whose piston 62 the device 56 is connected by means of a rod 64. A spring 66 incorporated in the actuator 60 biasses the device 56 to a position (towards the left in FIG. 4) in which the teeth of the bars 58 are meshed with those of the bars 54 when the actuator 60 is not pressurised.

Second drive means are incorporated in the upper arm 22 for carrying out the bending phase B described above. These second drive means comprise a numerically-controlled electric motor 68 whose shaft carries a drive gear 70. The drive gear 70 transmits the drive to a driven ring gear 72, in the case shown through a toothed belt 74.

The ring gear 72 is fixed firmly to the body of a female screw member 76 supported by bearings 78.

A horizontal rod 80, perpendicular to the working direction Z, is associated with the female screw member 76. The rod 80 comprises a ball screw portion 82 engaged with the female thread 76, and a prismatic portion 84. The prismatic portion 84 is fixed to a so-called "tripping" brake of known type, indicated 86. The function of this brake will be explained below.

At its end opposite to the female thread 76, the rod 80 carries a pair of wedges 88 which cooperate with respective facing wedge surfaces constituted by roller planes 90, 92. The roller plane 90 is located on the upper part of the first slide 26 and is inclined like the corresponding face of the wedge 88. The roller plane 92 is located on an inner cross-member 94 of the arm 24, is horizontal, and cooperates with a corresponding horizontal face of the wedge 88.

Upward repulsion springs 42 are interposed between the structure of the arm 24 and the first slide 26. These springs serve to support the weight of the whole movable apparatus constituted by the two slides 26 and 32, when they are fixed together, so as to ensure the constant engagement of the roller planes 90 and 92 with the wedges 88 during the bending and coining phases of which more will be said below.

An optical scale 96 which extends parallel to the working direction Z is associated with the first slide 26. An opto-electronic transducer (not shown) cooperates with this optical scale 96 and enables the loop for activating the servo-motor 68 to be closed.

The lower arm 22 of the frame 10 contains drive means provided for the coining phase C described above.

As shown in FIG. 3, these third drive means comprise a double-acting pneumatic cylinder 98 whose body is fixed to the frame 10. The piston 100 of the actuator 98 has a horizontal rod 102 which extends perpendicular to the working direction Z. At its end, the rod 102 carries a wedge 104 the function of which is similar to that of the wedges 88.

The lower tool-holder beam 12 forms part of a slide 106 which is guided in the arm 22 and is movable in the working direction Z. The wedge 104 cooperates with respective facing wedging surfaces constituted by roller planes 108, 110, the first of which is carried by a fixed block 112 and the second of which is carried by the slide 106.

The operation of the press shown in FIGS. 3 to 5 is as follows.

At the start of the approach phase A, the second slide 32 is released from the first slide 26 and is raised to a position corresponding to the position of the movable tool-holding beam 14 shown by the line 14*a* (FIG. 4).

When the piece W has been inserted in the press, the actuator 38 is pressurised and the rod 42 descends in the direction of the arrow $F_1$. By virtue of the kinematic multiplier mechanism 46-48-52, the second slide 52 is driven downwards into the first slide 26 by the distance H of FIGS. 2A, which is twice the travel of the rod 42. At the end of the approach stroke, the tool-holding beam 14 is in the position indicated by the line 14*b* of FIG. 4.

Under these conditions, the apparatus 56, whose toothed bars 58 were disengaged from the toothed bars 54, is driven (FIG. 4) by virtue of the fall in pressure in the actuator 60 and, by virtue of the meshing of the toothed bars 54 and 58, the two slides 26 and 32 become fixed firmly together.

At this point the phase B of bending under numerical control starts.

The servo-motor 68 is supplied and controlled in accordance with a previously-established programme in which the successive positions in the descent of the beam 14 and of the punch 18 are read on the optical scale 96. The operation of the servo-motor 68 moves the wedge 88 in the direction of the arrow $F_3$ causing the simultaneous descent of the beam 14 and of the punch 18 in the direction of the arrow $F_4$ by the distance K+K' of FIG. 2B.

Once the bending phase B is complete, the press carries out the coining phase C of FIG. 2C.

In order to carry out the coining, the actuator 98 is pressurised in the direction indicated by the arrow $F_5$ in which the wedge 104 wedges. With the movement of the wedge 104, the slide 106, the lower beam 12 and the die 16 undergo a virtual upward displacement in the direction of the arrow $F_6$ by the distance L+L' of FIG. 2C.

The coining force imparted by the wedge 104 is metered accurately by the variation of the pressure in the chamber of the actuator 98 by means of an electrically-controlled pressure regulator 114 of known type.

During the coining phase, it is necessary for the movable apparatus constituted by the punch 18, its punch-holder 14 and the slides 32 and 26, to be prevented rigorously from returning upwards under the coining force.

The kinematic reduction mechanism constituted by the female screw member 76 and the ball screw 82 is generally reversible so that it would permit this return travel. A "tripping" brake 86 is provided to prevent this return. The brake 86 also has the advantage that it transfers the reaction force due to the coining directly from the wedge 88 to the arm 24 of the frame 10 without affecting the screw-coupling unit 76–82 which may thus be undersized with respect to the coining force.

The practical embodiment shown in FIGS. 3 to 5 is not the only one possible. Thus in spite of the fact that the use of a numerically-controlled servo-motor 68 is preferred, the use of hydraulic servo-motors is not excluded.

In addition the press could lack the third coining drive means, or these means could be associated with a third slide incorporated in the upper arm, in the apparatus of the first and of the second slides described above.

Another embodiment of the invention will now be described with reference to FIGS. 6 to 9.

The bending press includes a pair of C-shaped structures (first supporting frames) 1100. A lower fixed beam (fixed apron member) 1102 carrying a die (lower bending tool) 1104 is fixed to the lower arm of the structure 1100.

An upper movable beam (movable apron member) 1106 carrying the punch (upper bending tool) 1108 is guided only by the upper arms of the structure 1100. In the present case, it is assumed that the two beams 1102 and 1106 are continuous but modular beams could be involved.

Figure 6:
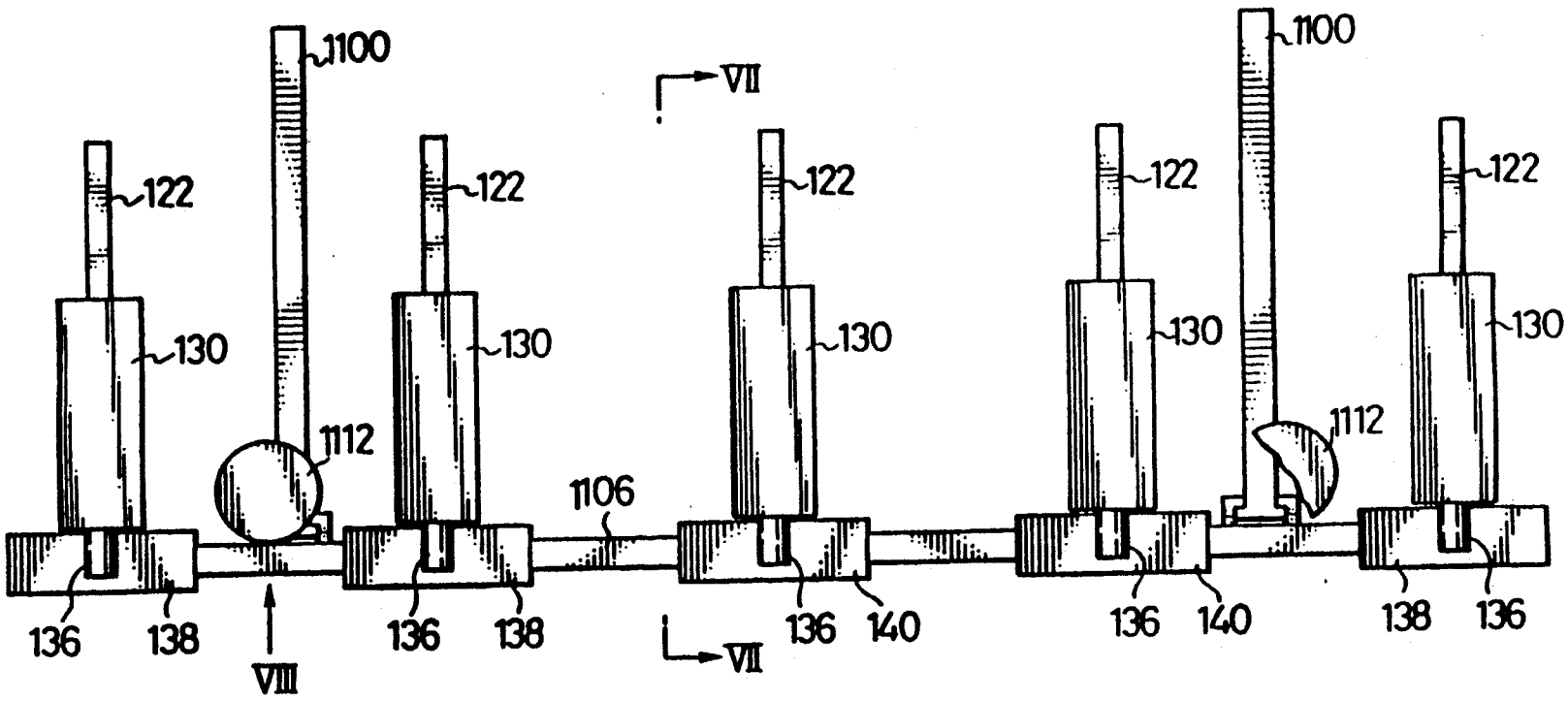
FIG. 6 is a schematic plan view from above of a bending press according to another embodiment of the invention.
Figure 8:
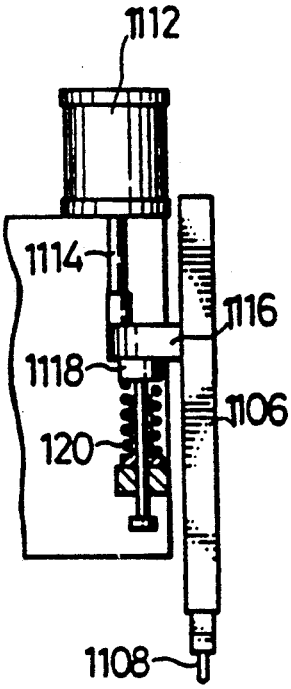
FIG. 8 is a schematic partial elevation taken on the arrow VIII of FIG. 6.

As shown in FIGS. 6 and 8, the top of each structure 1100 carries a double-acting hydraulic or pneumatic actuator 1112 having a vertical axis and all-or-nothing operation. A lower rod 1114 of each actuator 1112 carries a bracket 1116 from which the movable beam 1106 is suspended.

The two actuators 1112, one for each structure 1100, are operated in unison to implement the single approach stroke of the punch 1108 towards the die 104 for the bending, and its return stroke after the bending.

Upon completion of the approach stroke, the bracket 1116 bears on the end-of-travel stop constituted by a support 1118 which yields against the force of a spring 120. The spring 120 is preloaded so as to support the weight of the entire movable component of the beam 1106.

The press also includes a plurality (n+1) of at least three equidistant C-shaped structures (second supporting members) 122 provided for the bending stage only, according to the principles described above.

Each of these C-shaped structures 122 is mounted isostatically, for example, on a horizontal pin 124 fixed to the lower beam 1102, as shown. If desired, the C-shaped structures 122 may be mounted on the lower beam 1102, free to rotate about the horizontal pin 124. Its weight is balanced by a respective spring 126 so that the upper arm of the structure 122 is kept in contact with the upper movable beam 1106 by means of a roller 128.

The upper arm of each C-shaped structure 122 carries a reaction unit, generally indicated 130. The unit 130 comprises a hydraulic or pneumatic actuator 138 which has all-or-nothing operation and a horizontal rod 134 carrying a reaction bar of bolt 136.

In correspondence with each bolt 136, the movable beam 1106 carries a servomotor unit which will be described below with reference to FIG. 9.

Figure 7:
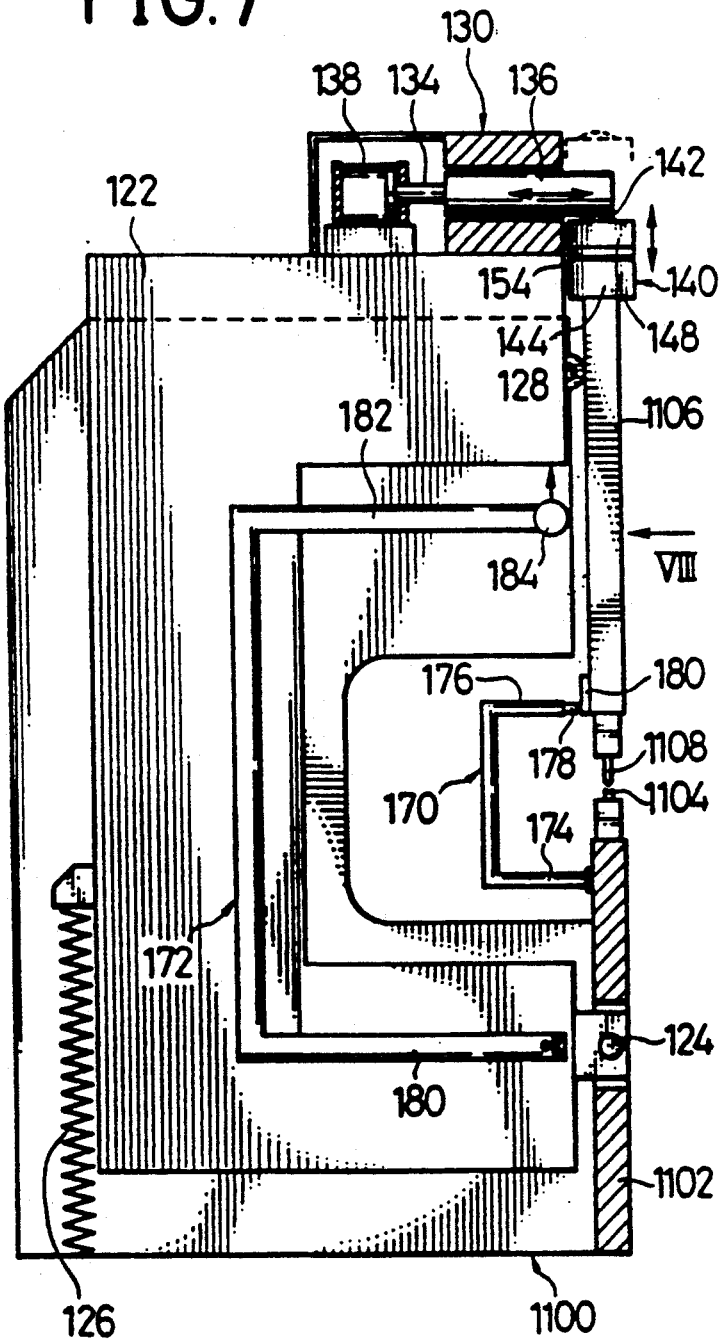
FIG. 7 is a schematic cross-section taken in the vertical plane VII-VII of FIG. 6, on an enlarged scale.

In FIG. 7, the position of a servomotor unit 140 (or 138) at the end of its approach stroke is shown in continuous outline and its position at the end of its return stroke is shown in broken outline.

Each unit 140 (and 138) has a spherical cap 142 at its top. When the unit 140 has reached the end of its approach stroke, the bolt 136 is advanced to the position shown in FIG. 7, so as to prevent the unit and the beam 1106 from returning upwardly.

Figure 9:
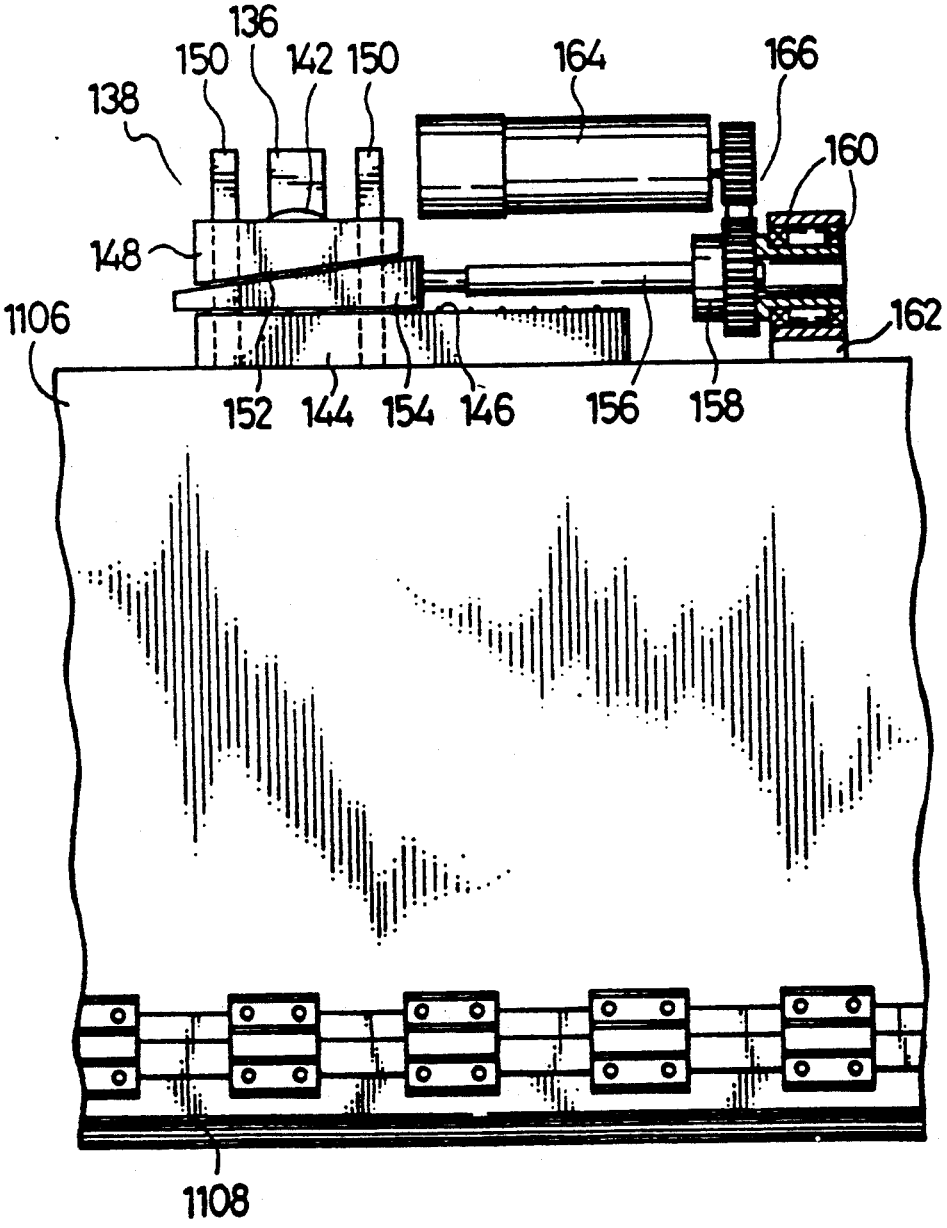
FIG. 9 is a schematic front elevational view taken on the arrow IX of FIG. 7.

With reference to FIG. 9, each servomotor unit 140 (and 138) includes a lower block or support 144 which is fixed to the top of the movable beam 1106 in correspondence with one of the structures 122. This block 144 has an upper wedging surface 146 constituted by a roller table. Another block 148, of which the cap 142 forms a part, is coupled for vertical sliding in vertical guides 150 also fixed to the movable beam 1106. The block 148 has an inclined wedging surface 152 which faces the surface 146 and is also constituted a roller table.

A corresponding wedge 154 is situated between the two wedging surfaces 146 and 152. The wedge 154 is fixed to an operating shaft 156 in the form of a ball screw.

A female thread 158 cooperates with the ball screw and is rotatable in bearings 160 mounted in a support 162 fixed to the top of the movable beam 1106.

The movable beam 1106 also carries a numerically-controlled electric servomotor 164 which rotates the female thread 158 by means of a transmission 166, for example a toothed belt.

As in the aforementioned patent application of the same date, once the movable beam 1106 has completed its approach stroke by the devices 112, 114, 146, the servomotor 164 corresponding to each C-shaped structure 122 is operated so as to thrust the wedge 154 between the two wedging surfaces 146 and 152 and thus effect the bending stroke.

All the servomotor units are substantially identical from the kinematic point of view, and the only difference is that the servomotors of the units 138 situated at the ends of the beam are adapted to exert a thrust force of $P/n(n-1)$, where n is the number of C-shaped structures 122, whilst the servomotors of the units 140 corresponding to the intermediate structures 122 are adapted to exert a thrust force of $P/(n-1)$ on the movable beam 1106.

In the embodiment of FIGS. 7 to 9, each C-shaped structure 122 is also provided with auxiliary detection structures 170 and 172, both of which are C-shaped. The structure 170, which measures the relative displacement of the punch and the die, includes a lower arm 174 fixed to the lower beam 1102 and an upper arm 176 which carries an opto-electronic transducer 178 cooperating with an optical line 180.

The other auxiliary structure 172 measures the deformation of the structure 122 and is necessary since, in the case in question, the movable beam 1106 is continuous. This structure 172 comprises a lower arm 180 fixed to the lower arm of the C-shaped structure 122 and an upper arm 182 which carries a transducer 184 for detecting the deformation of the structure 122 so as to identify the zero position, when the punch 1108 and the die 1104 are in contact with each other, for the servosystem of each of the C-shaped structures 122.

Although a preferred embodiments are specifically illustrated and described herein, it will be appreciated that many modifications and variations of the present invention are possible in light of the above teachings and within the purview of the appended claims without departing from the spirit and intended scope of the invention.

For example, in the bending machine shown in FIGS. 2 to 5 and FIGS. 6 to 9, the upper beam may be fixed and the lower beam may be movable vertically in the general planes.

What is claimed is:

1. A sheet workpiece bending machine comprising:

a frame;

a first slide member mounted on the frame for movement in a vertical direction;

a second slide member mounted on the first slide member for movement in the vertical direction and carrying one of an upper and a lower bending tool, the other of the upper and the lower tools mounted so as to cooperate with the other tool to effect bending in a sheet workpiece;

a first drive means kinematically interposed between the first slide member and the second slide member to make the second slide member travel a relatively long first distance with respect to the first slide member so that the upper and lower bending tools are caused to move toward each other in an approach phase;

an engage/disengage means associated with the first and the second slide members for causing the two slide members to engage with or disengage from each other; and a second drive means kinematically interposed between the first slide member and the frame to make the first slide member travel a second distance, short relative to the first distance, in a bending phase.

2. The sheet workpiece bending machine of claim 1, wherein the engage/disengage means includes a first set of teeth provided on the first slide member and a second set of teeth provided on the second slide member, the first and second teeth being adapted to mesh with each there.

3. The sheet workpiece bending machine of claim 1, wherein the second drive means includes a numerically-controlled electric motor.

4. The sheet workpiece bending machine of claim 3, wherein the second drive means includes a wedge which cooperates with a first wedge surface formed in the frame and a second wedge surface formed in the first slide member.

5. The sheet workpiece bending machine of claim 1 wherein the first drive means includes a hydraulic actuator.

6. The sheet workpiece bending machine of claim 5, wherein the first drive means includes a third set of teeth provided on the first slide, a fourth set of teeth provided on the second slide, and a sprocket provided on a piston rod of the hydraulic actuator, the sprocket being adapted to mesh the third and fourth set of teeth simultaneously.

* * * * *